US008588630B2

(12) United States Patent
Kurimoto et al.

(10) Patent No.: US 8,588,630 B2
(45) Date of Patent: Nov. 19, 2013

(54) IMAGE FORMING APPARATUS

(75) Inventors: Eiji Kurimoto, Shizuoka (JP); Hiroshi Ikuno, Kanagawa (JP); Keisuke Shimoyama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 142 days.

(21) Appl. No.: 13/343,910

(22) Filed: Jan. 5, 2012

(65) Prior Publication Data

US 2012/0183313 A1 Jul. 19, 2012

(30) Foreign Application Priority Data

Jan. 13, 2011 (JP) ..... 2011-004762

(51) Int. Cl.
*G03G 21/00* (2006.01)

(52) U.S. Cl.
USPC ..... 399/34; 399/36

(58) Field of Classification Search
USPC ..... 399/9, 34, 36, 167, 350
See application file for complete search history.

(56) References Cited

U.S. PATENT DOCUMENTS 6,993,281 B2 1/2006 Yoshizawa et al.
7,110,699 B2 9/2006 Yoshizawa et al.
7,295,796 B1 11/2007 Murakami et al.
2009/0097870 A1* 4/2009 Misumi et al. ..... 399/36
2009/0190939 A1* 7/2009 Satoh et al. ..... 399/34
2011/0286777 A1 11/2011 Sugino et al.

FOREIGN PATENT DOCUMENTS

JP 2004-226482 8/2004
JP 2008-65115 3/2008
JP 2009-205121 9/2009

* cited by examiner

*Primary Examiner* — Hoang Ngo
(74) *Attorney, Agent, or Firm* — Cooper & Dunham LLP

(57) ABSTRACT

An image forming apparatus having a rotary image bearing member, a charging device to charge the image bearing member. an irradiator to irradiate the image bearing member to form a latent electrostatic image thereon, a developing device to develop the latent electrostatic image with a developing agent containing toner to obtain a visible image, a transfer device to transfer the visible image to a recording medium, a first cleaner that slidably contacts the image bearing member to remove toner remaining thereon, a driving mechanism to drive the image bearing member at different linear speeds, a noise detector provided in the vicinity of the image bearing member to detect noise, and an abnormal noise predictor device to predict whether abnormal noise hear during image formation based on noise detected by the noise detector when the image bearing member is driven not during image formation at a linear speed different from that during image formation.

10 Claims, 2 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2011-004762, filed on Jan. 13, 2011 in the Japanese Patent Office, the entire disclosure of which is hereby incorporated by reference herein.

BACKGROUND OF THE INVENTION

1. Field of the Invention

The present invention relates to an image forming apparatus.

2. Description of the Background Art

Electrophotographic image forming apparatuses that can produce high-quality images over an extended period of time have come to be demanded by consumers in recent years. Moreover, environmental concerns have accelerated demand for longer-lasting machines including longer-lasting parts and supplies, which requirement is expected to be satisfied without sacrificing quality.

To meet this demand, durable electrophotographic image forming apparatuses have already been commercialized, for example, by using stable photoreceptors (also referred to as photoconductors or image bearing members) having excellent abrasion resistance with a long working life.

In such image forming apparatuses, image bearing members having greatly improved durability are used for an extended period of time. As a result, however, over time the surface of the image bearing member undergoes changes, producing an abnormal (unpleasant, squeaky) noise due to abrasion between the image bearing member and a cleaner contacting the image bearing member.

Japanese patent application publication no. 2004-226482 (JP-2004-226482-A) describes detecting a part emitting abnormal noises heard in an image forming apparatus in operation by using a sound-collecting microphone.

However, typically image forming apparatuses of late are irregularly used in various environments and under different usage conditions. Therefore, for example, when such an image forming apparatus is continuously used in an unexpected manner, the main unit and parts of the image forming apparatus deteriorate and the surface property of the image bearing member changes. This causes a problem of abrupt abnormal noises during use of the image forming apparatus even during the warranty period.

In particular, when such situations occur during long uninterrupted printing, the abnormal noises never stop until the job ends, which obliges a user or operator to continue hearing the unpleasant noises. Unfortunately, this is unavoidable.

JP-2009-205121-A describes detecting poor cleaning performance by using a noise sensor that catches the noise in the apparatus. However, even with this configuration it is difficult to prevent the outbreak of the abnormal noises described above.

SUMMARY OF THE INVENTION

In view of the foregoing, the present invention provides an improved image forming apparatus having a rotary image bearing member, a charging device to charge the image bearing member, an irradiator to irradiate the image bearing member to form a latent electrostatic image thereon, a developing device to develop the latent electrostatic image formed on the image bearing member by irradiation with a developing agent containing toner to obtain a visible image, a transfer device to transfer the visible image to a recording medium, a first cleaner that slidably contacts the image bearing member to remove toner remaining thereon, a driving mechanism operably connected to the image bearing member to drive the image bearing member at different linear speeds, a noise detector provided in the vicinity of the image bearing member to detect noise, and an abnormal noise predictor device to predict outbreak of abnormal noise during image formation based on noise detected by the noise detector when the image bearing member is driven not during image formation at a linear speed different from that during image formation.

It is preferred that, in the image forming apparatus mentioned above, the cleaner is a cleaning blade.

It is still further preferred that, in the image forming apparatus mentioned above, the noise detector is a microphone.

It is still further preferred that, in the image forming apparatus mentioned above, the linear speed at which the image bearing member is driven not during image formation is greater than that during image formation.

It is still further preferred that, in the image forming apparatus mentioned above, the speed at which the driving mechanism rotates the image bearing member not during image formation is between 1.2 and 5 times greater than the speed at which the driving mechanism drives the image bearing member during image formation.

It is still further preferred that, in the image forming apparatus mentioned above, the abnormal noise predictor device predicts outbreak of the abnormal noise during image formation when at least one of noise that matches the frequency of friction noise generated by friction between the image bearing member and another part such as the first cleaner of the image forming apparatus, noise having a volume greater than a predetermined volume, and noise having a sound pressure greater than a predetermined sound pressure is contained in noise detected by the noise detector while the image bearing member is driven not during image formation at a linear speed greater than that during image formation.

It is still further preferred that, in the image forming apparatus mentioned above, the abnormal noise predictor device further includes a noise recorder to record noise detected by the noise detector and an cumulative information analyzer to analyze noise captured by the noise recorder.

It is still further preferred that, in the image forming apparatus mentioned above, the abnormal noise predictor device diagnoses whether at least one of the image bearing member and the cleaner that slidably abrades the image bearing member is broken based on analysis results provided by the cumulative information analyzer.

It is still further preferred that the image forming apparatus mentioned above further includes a second cleaner provided separately from the first cleaner that slidably contacts the image bearing member to remove toner remaining thereon; and a cleaning control unit operably connected to the second cleaner to control a contact pressure with which the second cleaner contacts the image bearing member based on prediction results provided by the abnormal noise predictor device.

It is still further preferred that the image forming apparatus mentioned above further includes an abnormal noise prediction alerting device to provide notification of prediction results provided by the abnormal noise predictor device.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The image forming apparatus of the present disclosure is described in detail with reference to accompanying drawings.

First Embodiment

Figure 1:
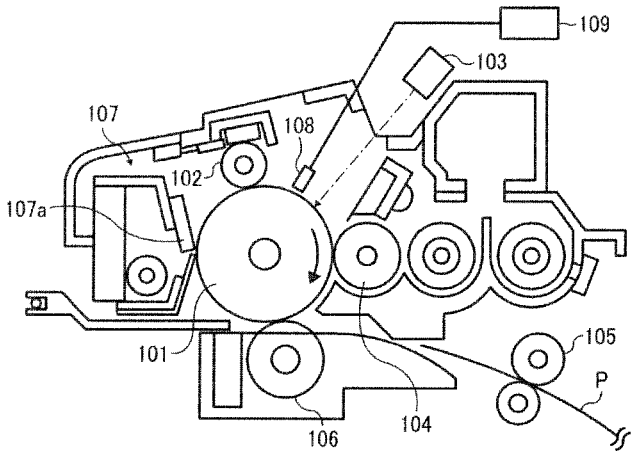
FIG. 1 is a schematic cross-sectional view illustrating an example of the main part of the image forming apparatus according to the present disclosure.

FIG. 1 is a schematic cross-sectional view illustrating an example of the main part of the image forming apparatus according to the present disclosure.

As illustrated in FIG. 1, the image forming apparatus includes a photoreceptor 101 having a cylindrical form, which is an example of a rotary image bearing member. Around the photoreceptor 101 are provided a charger 102 having a charging roller, an irradiator 103, a developing device 104 having a developing roller, a transfer device 106 that transfers a developed image (toner image) to a recording medium (typically, paper) P, and a cleaner 107 having a cleaning blade 107*a* that abrasively contacts the circumference surface of the photoreceptor 101 in the sequence of the rotation direction of the photoreceptor 101 indicated by an arrow in FIG. 1. In addition, the photoreceptor 101 is irradiated between the charger 102 and the developing roller by the irradiator 103.

The transfer device 106 is provided facing the bottom face of the photoreceptor 101. The portion of the photoreceptor 101 facing the transfer device 106 is the transfer portion. A pair of registration rollers 105 is provided on the upstream side of the transfer portion relative to the transfer direction of the recording medium P. The recording medium P accommodated in a paper feeding tray is fed by paper feeding rollers and transferred to the registration rollers 105 by a transfer guide. In addition, on the downstream side of the transfer portion relative to the transfer direction of the recording medium P, a fixing device is arranged.

The image forming apparatus illustrated in FIG. 1 produces images by the following image forming processes. The photoreceptor 101 is caused to start rotating clockwise in FIG. 1 by a driving unit (mechanism), charged by the charger 102 during rotation in the dark, and scanned by a laser beam by the irradiator 103.

Original image signals read from an original by an image reader or produced by an outside computer are input to an image processor. Input image signals obtained by suitable image processing are input into the irradiator 103 and the laser beams are modulated based on the input image signals to form a latent electrostatic image on the photoreceptor 101 corresponding to a target image. The latent electrostatic image on the photoreceptor 101 is moved by the rotation of the photoreceptor 101 to the developing device 104 and developed with toner by the developing device 104.

The recording medium P is fed from the paper feeder tray, temporarily held at the position of the registration rollers 105, and waits for the timing to meet the toner image on the photoreceptor 101 at the transfer position. The registration rollers 105 rotate on the timing to send out the recording medium P to the transfer portion. The toner image on the photoreceptor 101 meets the recording medium P at the transfer portion and is transferred onto the recording medium P by the electric field generated by the transfer device 106.

The recording medium P that bears the thus-transferred toner image is sent out to the fixing device. The toner image on the recording medium P is fixed thereon while the recording medium P passes through the fixing device and the recording medium P on which the toner image is fixed is discharged to a discharging unit. Toner remaining on the photoreceptor 101 that has not been transferred at the transfer portion is transferred to the cleaner 107 by the rotation of the photoreceptor 101 and removed by abrasion with the cleaning blade 107*a* to make the photoreceptor 101 ready for the next image forming process.

In the course of repeating the image forming process described above tens of thousands of or millions of times, the photoreceptor 101 are degraded by different kinds of damage. The conceivable causes of such degradation are, for example: oxidization of the surface of the photoreceptor 101 by ozone and nitrogen oxide gases produced in the course of the charging process described above; and materials gradually accumulated and fixated on the surface of the photoreceptor 101 such as toner or additives contained therein that could not be removed in the cleaning process and paper dust produced from the recording medium P, etc. This affects the photoreceptor 101 and consequently changes the surface property thereof Such a phenomenon, i.e., some impact on the surface property of the photoreceptor 101 and changes thereof on one level or another due to repetitive use is inevitable. Such changes in the surface property, for example, the dynamic friction coefficient causes abnormal noises such as unpleasant squeaky (abrasion) noise due to the abrasion of the photoreceptor 101 with the cleaning blade 107*a* of the cleaner 107.

This did not use to be a problem because photoreceptors were abraded sooner and replaced before such abnormal noises heard. However, now greatly improved photoreceptor 101 has an extremely long working life, which leads to problems such as the abnormal noises. These abnormal noises start abruptly when deterioration of the surface of the photoreceptor surpasses a certain threshold.

In an attempt to solve this problem, the present inventors have found that such abnormal noises change depending on the linear speed (corresponding to rotation speed for a cylindrical photoreceptor) and become larger as the speed of the rotation speed increases. Based on this, the present inventors have thus made the present invention.

That is, the image forming apparatus illustrated in FIG. 1 has a driving mechanism operably connected to the photoreceptor 101 that drives the photoreceptor 101 in such a manner that the linear speed thereof can be changed, a noise detector 108 such as a microphone that is provided around the photoreceptor 101 to detect noises, and an abnormal noise predictor device 109 that predicts occurrence of abnormal noises heard during image formation based on the noises detected by the noise detector 108 when the photoreceptor 101 is driven at a different timing from image forming (i.e., not in image forming) at a different linear speed from that during image formation.

The linear speed of the photoreceptor 101 is changed by the driving mechanism by changing the rotation speed (number of rotation) of the motor serving as the driving portion that transmits a driving force to the photoreceptor 101 by the control unit for the entire image forming apparatus. With regard to the rotation speed of the motor, the rotation speed is preferably increased about 1.2 to about five times and more preferably about 1.5 to three times as much as that during normal image forming processing. When the motor speed is not increased sufficiently, it is difficult to detect the change in the noise for prediction. When the motor speed is too high, friction heat between the photoreceptor 101 and the cleaning blade 107*a* appears which makes another factor of deterioration.

The linear speed of the photoreceptor 101 can be changed by using a mechanism in which the gears present in the process of transmitting the driving force from the driving mechanism to the photoreceptor 101 are replaced with gears having a different number of cogs.

A device such as a typical microphone that changes vibration (sound wave) transmitting in the air into electric signals can be used as the noise detector 108. The typically used microphone is classified into a dynamic type, a condenser type, an electret type. etc., all of which can be suitably used. In addition, with regard to the size of the noise detector 108, considering that it is installed inside of an image forming apparatus, small microphones such as a pin microphone are preferable. Unidirectional microphone, which is less affected by extra noises from the back, etc., is particularly preferable.

Although the noise detector 108 is provided above the peripheral of the photoreceptor 101 and between the charger 102 and the light path of the laser beam from the irradiator 103 in FIG. 1, there is no specific limit to where the noise detector 108 is provided. The noise detector 108 can be positioned around the photoreceptor 101 anywhere the target noise can be detected without having an impact on image forming.

The abnormal noise predictor device 109 is provided, for example, in such a manner that the control unit of the image forming apparatus receives the electric signals from the noise detector 108 and determines whether the abnormal noise is going to occur during image formation from the received entire noises, noises corresponding to the frequency of the abrasion noise between the photoreceptor 101 and the cleaning blade 107*a*, noises greater than a predetermined noise, and sound pressure greater than a predetermined sound pressure. Alternatively, any noise detected by the noise detector 108 is determined as an abnormal noise.

The different timing from image forming represents any timing other than that of normal image forming, for example, after image forming or before image forming a certain amount of time after image forming In addition, the different linear speed from image forming is a linear speed of the photoreceptor 101 intentionally increased from that during image formation.

The friction noise heard when the photoreceptor 101 is driven by the driving mechanism at the different linear speed greater than the linear speed during image formation at the different timing is larger than that during normal image forming Therefore, the abnormal noise predictor device 109 predicts occurrence of an abnormal noise from a small noise or a noise including at least one of noises corresponding to the frequency of the abrasion noise between the photoreceptor 101 and the cleaning blade 107*a*, noises greater than a predetermined noise, and sound pressure greater than a predetermined sound pressure detected by the noise detector 108 provided around the photoreceptor 101 before the abnormal noise actually starts to hear.

Second Embodiment

Figure 2:
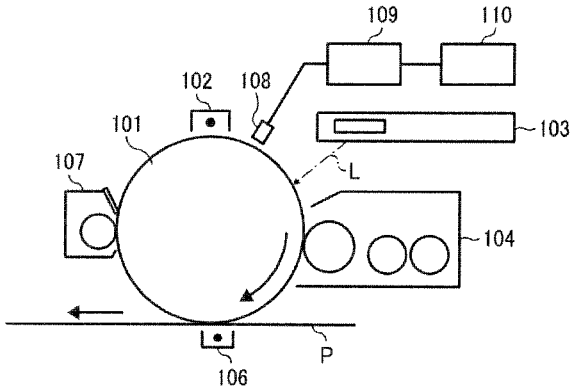
FIG. 2 is a schematic cross-sectional view illustrating another example of the main part of the image forming apparatus according to the present disclosure.

FIG. 2 is a schematic cross-sectional view illustrating another example of the main part of the image forming apparatus according to the present disclosure.

In FIG. 2, the photoreceptor 101, the charger 102, the irradiator 103, the developing device 104, the transfer device 106, the cleaner 107, the noise detector 108, and the abnormal noise predictor device 109 are the same as in the first embodiment (illustrated in FIG. 1) and the operation in the image forming process and the operation in the abnormal noise prediction process are also the same.

The image forming apparatus of the second embodiment is connected to the abnormal noise predictor device 109 to receive signals therefrom and has an abnormal noise prediction alerting device 110 that alerts a user or a field engineer to the prediction result of the abnormal noise predictor device 109.

When the abnormal noise prediction alerting device 110 has a feature of alerting an operator, a user, or a field engineer with a prediction of occurrence of abnormal noise by optical information by luminescence of a luminescent diode, a beep tone, a voice, etc. when the abnormal noise prediction alerting device 110 receives an electric signal indicating the prediction of occurrence of abnormal noise from the abnormal noise predictor device 109. Therefore, a user or a field engineer is securely notified of the abnormal noise information predicted by the abnormal noise predictor device 109 so that he or she can take a necessary measurement such as replacement of the cleaning blade 107*a* to prevent occurrence of abnormal noises.

Third Embodiment

Figure 3:
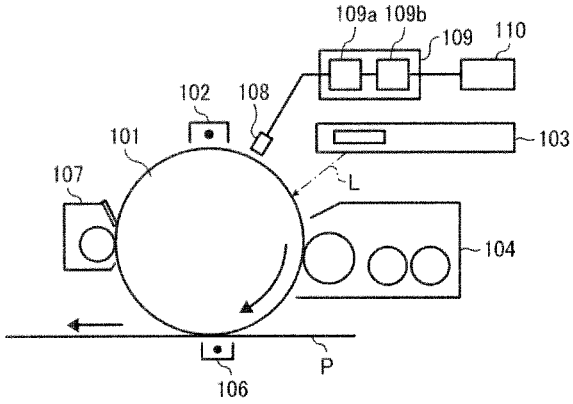
FIG. 3 is a schematic cross-sectional view illustrating yet another example of the main part of the image forming apparatus according to the present disclosure.

FIG. 3 is a schematic cross-sectional view illustrating another example of the main part of the image forming apparatus according to the present disclosure.

In FIG. 3, the photoreceptor 101, the charger 102, the irradiator 103, the developing device 104, the transfer device 106, the cleaner 107, the noise detector 108, and the abnormal noise predictor device 110 are the same as in the second embodiment illustrated in FIG. 2 and the operation in the image forming process are also the same.

In the image forming apparatus of the present disclosure, the abnormal noise predictor device 109 has a noise recorder 109*a* to record the noise detection results of the noise detector 108 and an cumulative information analyzer 109*b* to predict the occurrence of an abnormal noise during the image forming process by analyzing noise information accumulated in the noise recorder 109*a*.

Any known generally used storage device, for example, a semiconductor memory can be used as the noise recorder 109*a*. The noise information recorded therein is formed by electrifying the noise information picked up by the noise detector 108 when the linear speed of the photoreceptor 101 is changed as described above. In addition, by saving the friction noise made by a used-up photoreceptor that should be replaced and the cleaning blade 107*a* as information of the noise of the end of working life of the photoreceptor 101, this information about the friction noise can be used for analysis by the cumulative information analyzer 109*b*.

The cumulative information analyzer 109*b* has a feature of converting the noise information accumulated in the noise recorder 109*a* into useful information. That is, the cumulative information analyzer 109*b* has a feature of determining whether a noise detected by the noise detector 108 when the linear speed of the photoreceptor 101 is changed indicates a change of the surface of the photoreceptor 101 that causes an abnormal noise during image formation from the noise information such as noise volume, sound pressure, and frequency.

With the structure described above, the abnormal noise prediction processing is as follows:

(S11) First, the photoreceptor 101 is driven at a timing different from that for image forming at a linear speed changed from (greater than) that for image forming;

(S12) The noise recorder 109*a* records the noise detected in S11 by the noise detector 108 as noise information;

(S13) The cumulative information analyzer 109*b* compares the noise (noise information) recorded by the noise detector 108 this time with the noise information about the noises detected by and accumulated in the noise detector 108 up to this time and determines whether the noise indicates a change of the surface of the photoreceptor 101 that causes an abnormal noise during image formation, alternatively, the cumulative information analyzer 109*b* compares the noise (noise information) recorded by the noise detector 108 this time with the noise information about the noise made by the photoreceptor 101 that has come to an end of life and determines whether the noise indicates a change of the surface of the photoreceptor 101 that causes an abnormal noise during image formation, that is, occurrence of an abnormal noise during image formation is predicted based on the noise detected by the noise detector 108 this time; and (S14) When the cumulative information analyzer 109*b* predicts the occurrence of an abnormal noise during image formation, the abnormal noise prediction alerting device 110 alerts a user or a field engineer with the prediction results of the abnormal noise predictor device 109 (cumulative information analyzer 109*b*).

As described above, before an actual abnormal noise hears, occurrence of the abnormal noise can be predicted by intentionally increasing the linear speed of the photoreceptor 101 from the linear speed during image formation and recording, accumulating, and analyzing the noise at the time detected by the noise detector 108.

In addition, when such an abrupt abnormal noise is predicted, a suitable countermeasure can be selected among the predetermined countermeasures by comparison and confirmation of the cumulative information and the newly obtained noise information.

For example, the abnormal noise predictor device 109 preferably has a breakdown diagnosis feature to determine whether the photoreceptor 101 and/or the cleaning blade 107*a* that slidably abrades therewith is broken down or predict the life expectancy thereof based on the analysis results of the cumulative information analyzer 109*b*.

That is, this noise detection system is applied to breakdown diagnosis by detecting the change in the property of the surface of the photoreceptor 101 from the noise information about the noise detected by the noise detector 108 when the linear speed of the photoreceptor 101 is changed. To be specific, by using the cumulative information analyzer 109*b*, breakdown diagnosis is conducted by determining how long the photoreceptor 101 and/or the contact member (cleaning blade 107*a*) can be used in the current image forming apparatus from the differences between the pre-obtained noise information about noises of the photoreceptor 101 and/or the contact member (cleaning blade 107*a*) that abrades therewith at the life expectancy, the noise information accumulated on the noise recorder 109*a*, and the noise information of the noise detected by the noise detector 108 when the linear speed of the photoreceptor 101 is changed. In addition, in this breakdown diagnosis, the noise information obtained when the linear speed of the photoreceptor 101 is changed while not in image forming and the noise information preliminarily recorded by the noise recorder 109*a* about the photoreceptor 101 that has come to an end of life under the same linear speed condition are compared and when each noise information is determined as positive match, the image forming apparatus is determined as abnormal, i.e., breakdown.

In general, usage of an image forming apparatus creates a significant difference about the state of the surface of the photoreceptor 101, that is, the accumulation state of foreign objects such as corona products and oxidized compounds. For example, the degree of the foreign objects and the oxidized compound accumulated on the surface of the photoreceptor 101 is greatly different between a case in which quantity of images having a thick image density are continuously printed consuming a great amount of toner and a case in which images close to no image are printed in the same number of pages consuming only a little amount of toner. In spite of such a difference about the state of the surface of the photoreceptor 101, the breakdown diagnosis feature makes a correct decision about when the device is broken down by using the preliminarily-obtained noise information of the noise detected by the noise detector 108 when the linear speed of the photoreceptor 101 is changed.

Fourth Embodiment

Figure 4:
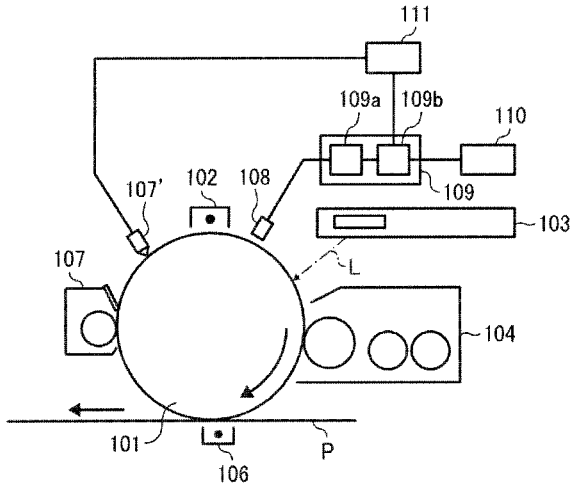
FIG. 4 is a schematic cross-sectional view illustrating still further another example of the main part of the image forming apparatus according to the present disclosure.

FIG. 4 is a schematic cross-sectional view illustrating another example of the main part of the image forming apparatus according to the present disclosure.

In FIG. 4, the photoreceptor 101, the charger 102, the irradiator 103, the developing device 104, the transfer device 106, the cleaner 107, the noise detector 108, the abnormal noise predictor device 109, the noise recorder 109*a*, the cumulative information analyzer 109*b*, and the abnormal noise prediction alerting device 110 are the same as in the third embodiment illustrated in FIG. 3 and the operation in the image forming process and the operation in the abnormal noise prediction process are also the same.

The image forming apparatus of the fourth embodiment has a cleaning control unit 111 that controls the cleaning condition of the surface of the photoreceptor 101 based on the prediction results of the abnormal noise predictor device 109 (i.e., the cumulative information analyzer 109*b*) To be specific, as illustrated in FIG. 4, the image forming apparatus has a (second) cleaner 107' provided separately from the cleaner 107 to clean the surface of the photoreceptor 101 and the cleaning control unit 111 that controls the cleaner 107' to remove foreign objects and oxidized compounds accumulated on the surface of the photoreceptor 101 while not in image forming based on the information (abnormal noise prediction result) in the cumulative information analyzer 109*b*. The cleaner 107' is connected via electric wire such as a cable to receive signals sent out from the cleaning control unit 111.

The cleaner 107' is provided separately from the cleaner 107 using an abrasive member (e.g., the cleaning blade 107*a* and a brush) provided to remove toner remaining on the surface of the photoreceptor 101 in the normal image forming process and does not operate in the normal image forming process but only when forcible removal of the foreign objects and oxidized compounds accumulated on the surface of the photoreceptor 101 is determined to eliminate the possibility of the machine making an abnormal noise based on the abnormal noise prediction processing results.

Any known device can be used as the cleaner 107'. It is preferable to slidably abrade the surface of the photoreceptor 101 strongly by pressing the cleaner 107' against the surface of the photoreceptor 101 under conditions (contact pressure) severer than those for the normal image forming process to remove materials causing abnormal noises such as corona products, etc. because these are gradually accumulated on the surface of the photoreceptor 101 and thus may be firmly attached thereto. Furthermore, if such materials cannot be removed by the mechanical contact described above (difficult to remove those by abrasive members) because these are related to chemical changes, a member impregnated in a solvent such as alcohol can be used to apply the solvent in a minute amount to the surface of the photoreceptor 101 to remove the accumulated object thereon.

Alternatively, instead of using the cleaner 107', it is also possible to make the cleaning blade 107*a* of the cleaner 107 contact and abrade the surface of the photoreceptor 101 under a severer condition (i.e., contact pressure) than that for the normal image forming process by using the cleaning control unit 111.

As described above, when abnormal noises are anticipated based on the abnormal noise prediction processing, a suitable cleaning condition can be selected based on the abnormal noise prediction information so that the surface property of the photoreceptor 101 can be improved and occurrence of the abnormal noise can be prevented.

Having now fully described embodiments of the present invention, it will be apparent to one of ordinary skill in the art that many changes and modifications can be made thereto without departing from the spirit and scope of embodiments of the invention as set forth herein.

For example, in the embodiments, although the examples are described in which the photoreceptor 101 and the cleaning blade 107*a* make abnormal noises by abrasion, the present invention is not limited thereto, but can be applied to, for example, any member that possibly makes abnormal noises by contacting the photoreceptor 101 during image formation.

In addition, as an example of the image forming apparatus employing electrophotography to which the present invention can be applied, photocopiers, facsimile machines, printers, and digital multi-functional machines are specified. The abnormal noise detection device can be fixed in an apparatus together with an image bearing member and a cleaner or installed in a process cartridge for the apparatus.

In addition, the present invention can be also applied to a full color tandem type image forming apparatus.

In this case, since multiple image bearing members are used, such abnormal noise detectors and series of devices required thereto are independently installed on respective image bearing members. Each mechanism is as described above and provided according to the number of the image bearing members.

As described above, the scope of the present invention covers almost all of the known image forming apparatus formed by using image bearing members employing electrophotography and any known system including the charging system, the development systems using toner, and the transfer system.

What is claimed is:

1. An image forming apparatus comprising:

a rotary image bearing member;

a charging device to charge the image bearing member;

an irradiator to irradiate the image bearing member to form a latent electrostatic image thereon;

a developing device to develop the latent electrostatic image formed on the image bearing member by irradiation with a developing agent comprising toner to obtain a visible image;

a transfer device to transfer the visible image from the image bearing member to a recording medium;

a first cleaner that slidably contacts the image bearing member to remove toner remaining thereon;

a driving mechanism operably connected to the image bearing member to drive the image bearing member at different linear speeds;

a noise detector provided in the vicinity of the image bearing member to detect noise; and an abnormal noise predictor device to predict outbreak of abnormal noise during image formation based on noise detected by the noise detector when the image bearing member is driven not during image formation at a linear speed different from that during image formation.

2. The image forming apparatus according to claim 1, wherein the cleaner is a cleaning blade.

3. The image forming apparatus according to claim 1, wherein the noise detector is a microphone.

4. The image forming apparatus according to claim 1, wherein the linear speed at which the image bearing member is driven not during image formation is greater than that during image formation.

5. The image forming apparatus according to claim 4, wherein the speed at which the driving mechanism rotates the image bearing member not during image formation is between 1.2 and 5 times greater than the speed at which the driving mechanism drives the image bearing member during image formation.

6. The image forming apparatus according to claim 1, wherein the abnormal noise predictor device predicts outbreak of the abnormal noise during image formation when at least one of a noise that matches the frequency of friction noise generated by friction between the image bearing member and another part of the image forming apparatus, noise having a volume greater than a predetermined volume, and noise having a sound pressure greater than a predetermined sound pressure is contained in noise detected by the noise detector while the image bearing member is driven not during image formation at a linear speed greater than that during image formation.

7. The image forming apparatus according to claim 1, wherein the abnormal noise predictor device further comprises:

a noise recorder to record noise detected by the noise detector; and a cumulative information analyzer to analyze noise captured by the noise recorder.

8. The image forming apparatus according to claim 7, wherein the abnormal noise predictor device diagnoses whether at least one of the image bearing member and the cleaner that slidably abrades the image bearing member is broken based on analysis results provided by the cumulative information analyzer.

9. The image forming apparatus according to claim 1, further comprising:

a second cleaner provided separately from the first cleaner that slidably contacts the image bearing member to remove toner remaining thereon; and a cleaning control unit operably connected to the second cleaner to control a contact pressure with which the second cleaner contacts the image bearing member based on prediction results provided by the abnormal noise predictor device.

10. The image forming apparatus according to claim 1, further comprising an abnormal noise prediction alerting device to provide notification of prediction results provided by the abnormal noise predictor device.

* * * * *